US005941729A

United States Patent [19]

Sri-Jayantha

[11] Patent Number: 5,941,729

[45] Date of Patent: Aug. 24, 1999

[54] SAFE-SNAP COMPUTER CABLE

[75] Inventor: Sri M. Sri-Jayantha, Ossining, N.Y.

[73] Assignee: International Business Machines Corporation, Armonk, N.Y.

[21] Appl. No.: 08/926,805

[22] Filed: Sep. 10, 1997

[51] Int. Cl.[6] ..... M01R 11/00

[52] U.S. Cl. ..... 439/505; 439/923; 439/289; 439/39

[58] Field of Search ..... 439/502, 503, 439/505, 289, 923, 956, 39; 174/66, 67

[56] References Cited

U.S. PATENT DOCUMENTS 4,077,690 3/1978 Koether ..... 439/923
4,484,185 11/1984 Graves ..... 174/66
5,399,102 3/1995 Devine ..... 439/923
5,573,425 11/1996 Morisawa et al. ..... 439/502

*Primary Examiner*—Neil Abrams
*Assistant Examiner*—T. C. Patel
*Attorney, Agent, or Firm*—Francis L. Conte

[57] ABSTRACT

An electrical cable for a portable computer includes a plurality of electrical leads bound together in a flexible sheath. A first snap connector is joined to the leads. A second snap connector is complementary to the first snap connector and is connected thereto for establishing electrical connection with the computer, and allowing self-disconnection thereof upon yanking of the cable over a range of angles relative to the computer including a hemisphere.

7 Claims, 3 Drawing Sheets

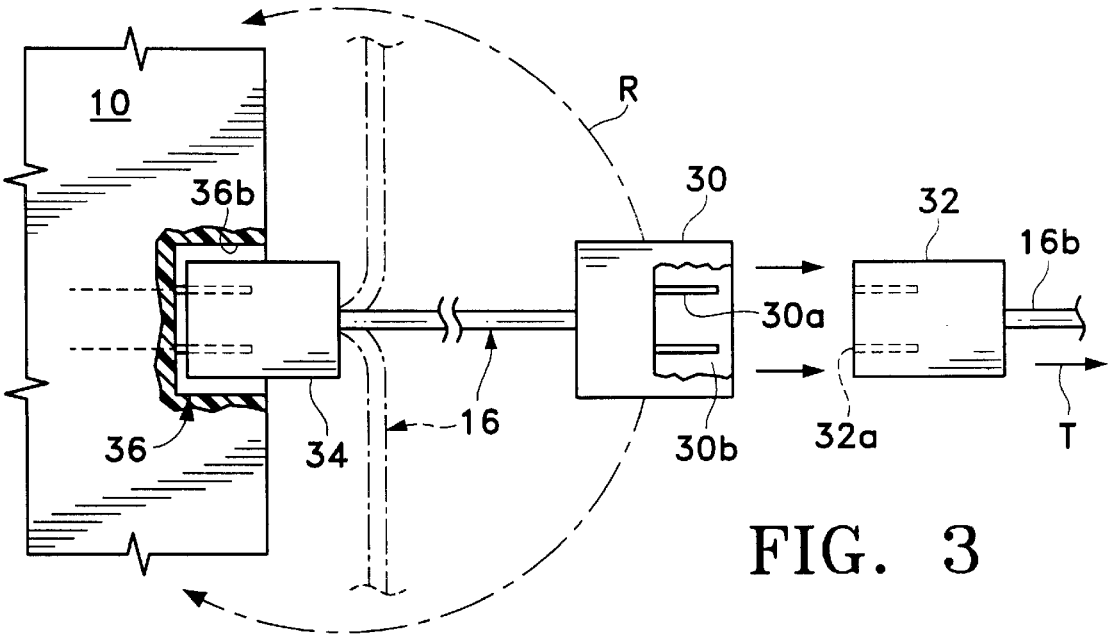
FIG. 3
FIG. 4
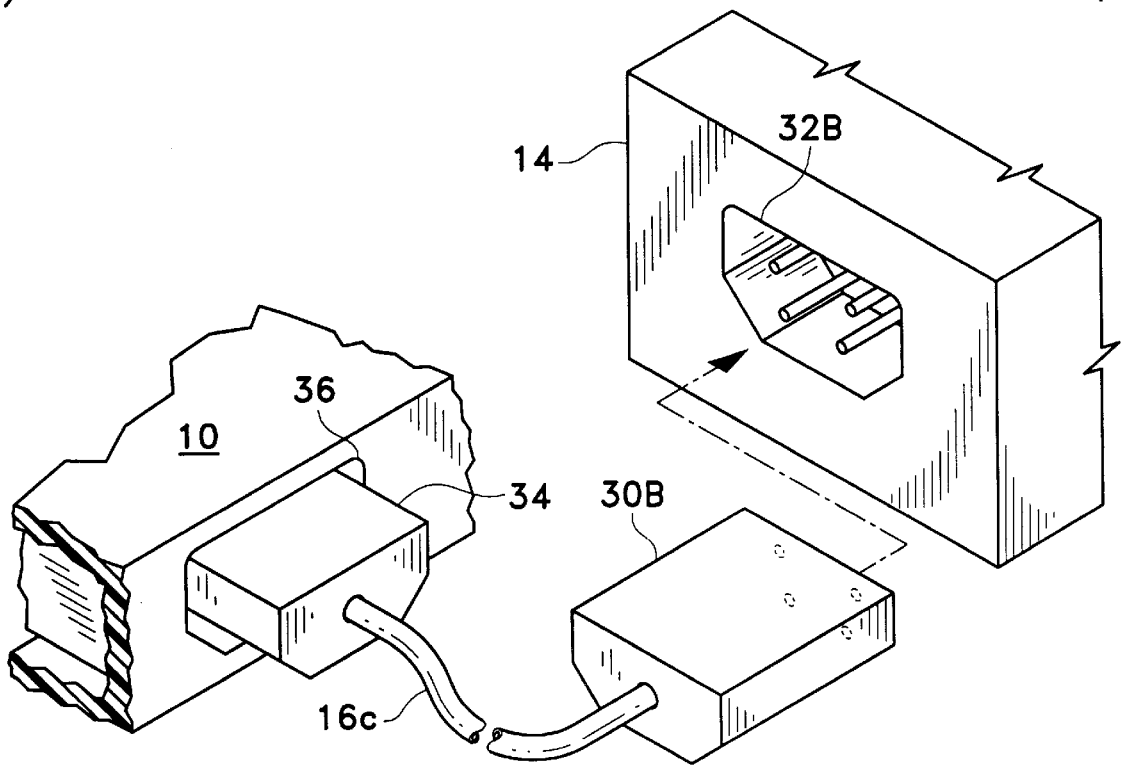

SAFE-SNAP COMPUTER CABLE

BACKGROUND OF THE INVENTION

The present invention relates generally to portable computers, and, more specifically, to cables therefor.

Portable computers typically referred to as laptop or notebook computers include internal batteries for allowing their unbridled use. An external power supply or battery charger may be used when required for powering the computer when the internal batteries are drained. The power supply itself includes a suitable transformer and rectifying circuit for converting alternating current (AC) line voltage to direct current (DC) power for both running the computer and recharging the internal batteries thereof.

The power supply therefore typically includes an input AC cable having a remote connector plug which may be inserted into a wall outlet for obtaining AC power. A DC output cable extends from the power supply and has a suitable end connector plug which removably engages a suitable receptacle in the back of the computer for providing DC power thereto. The computer receptacle is typically recessed into the housing thereof and includes a plurality of male pin terminals disposed inside the recess. The cooperating cable connector is typically in the form of a plug having a respective plurality of holes which define the terminals thereof which engage the receptacle terminals of the computer when plugged together. In this way, the power supply may be removably joined to the portable computer for temporarily providing DC power thereto for operating the computer and recharging the batteries thereof when desired.

Since the computer is relatively light weight for being portable, it is subject to yanking movement in the event the recharging cable is inadvertently tripped over which can easily provide sufficient force to pull the computer off its resting surface, such as a table, causing it to drop to the floor. The shock forces created upon dropping the computer to the floor may be sufficiently high for damaging the computer.

Since the cable plug is recessed into the back of the computer, any lateral yanking force will be ineffective in disconnecting the connector from the computer. Only within a very narrow cone angle extending outwardly from the computer receptacle will cable yanking allow self-disconnection from the computer. Since the connector is joined to the computer with a simple friction fit, relatively little force is required to not only join together these components, but also separate or disconnect these components.

It is therefore desirable to provide an improved cable for joining to a portable computer which allows self-disconnection due to yanking forces irrespective of the direction of yanking.

SUMMARY OF THE INVENTION

An electrical cable for a portable computer includes a plurality of electrical leads bound together in a flexible sheath. A first snap connector is joined to the leads. A second snap connector is complementary to the first snap connector and is connected thereto for establishing electrical connection with the computer, and allowing self-disconnection thereof upon yanking of the cable over a range of angles relative to the computer including a hemisphere.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which:

FIG. 3 is a top, partly sectional view of a portion of the computer and attached electrical cable illustrated in FIG. 1 showing an exemplary range of disconnection angles for the cable relative to the computer.

FIG. 4 is an exploded view of an electrical cable in accordance with another embodiment of the present invention joined to the computer and the power supply.

DESCRIPTION OF THE PREFERRED EMBODIMENT(S)

Figure 1:
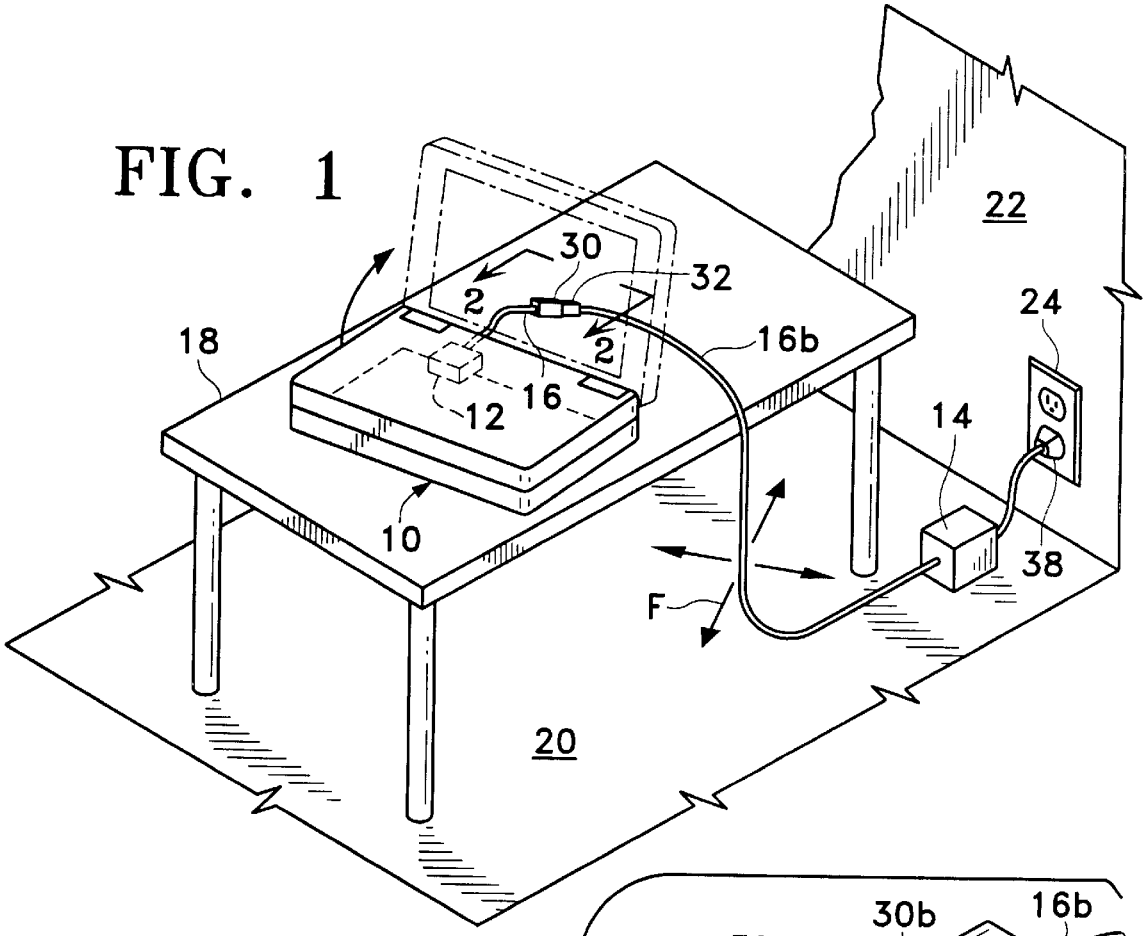
FIG. 1 is a perspective view of a portable computer resting atop a table and joined to a power supply using an electrical cable in accordance with an exemplary embodiment of the present invention.

Illustrated in FIG. 1 is an exemplary portable computer 10, also referred to as a laptop or notebook computer. The computer 10 may have any conventional form, and in the form of a notebook includes a pair of hinged leaves or wings which may be closed together as shown in solid line in FIG. 1 when the computer is not being used, or may be opened as shown in phantom for exposing both the viewing screen in the upper half of the computer and the keyboard in the lower half of the computer.

The computer 10 includes an internal battery 12 which provides suitable DC power for operating the computer 10 when desired. When the battery drains, it may be suitably recharged using a conventional power supply or battery charger 14 temporarily joined to the computer 10 using a flexible electrical cable 16 in accordance with an exemplary embodiment of the present invention. As illustrated in FIG. 1, the computer 10 may be temporarily placed atop a table 18 resting on the floor 20 adjacent to a wall 22 having a remote power source in the form of a conventional wall receptacle 24 for providing a suitable AC power, such as 110 volts. The power supply 14 is conventionally configured for transforming the AC power from the receptacle 24 to a suitably lower DC voltage compatible with the computer 10 for recharging the batteries 12 thereof.

As indicated above, a conventional power supply typically includes an integral electrical cable which plugs into the back of the computer 10 (not shown) which can yank the computer to the floor 20 upon inadvertent tripping of the cable thereof. In accordance with the present invention, the tripping force, designated F, may be used to advantage to self-disconnect the power supply 14 from the computer 10 without causing excessive force which would overcome friction of the computer 10 resting atop the table 18.

Figure 2:
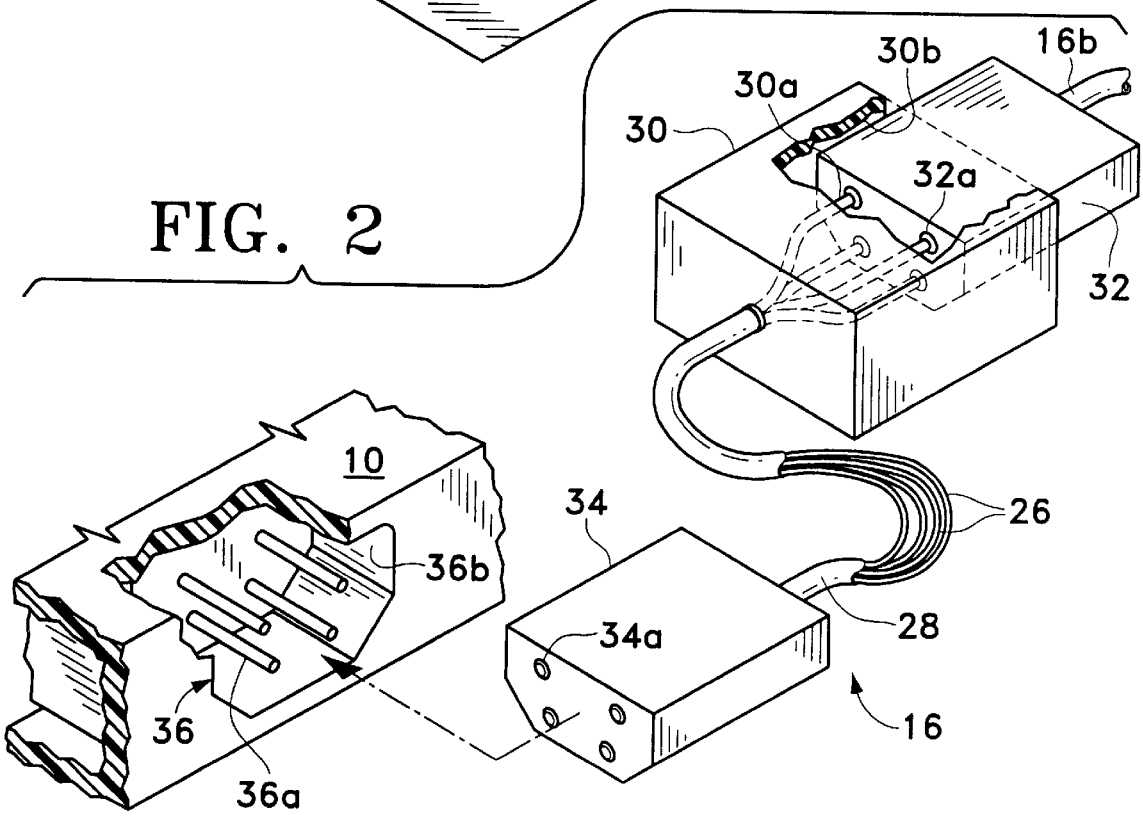
FIG. 2 is an exploded view of the back side of the computer illustrated in FIG. 1 and taken generally along line 2—2 showing the electrical cable in accordance with an exemplary embodiment of the present invention.

More specifically, the electrical cable 16 is illustrated in more detail in an exemplary embodiment in FIG. 2 and includes a plurality of electrical leads or wires 26 bound together in a common sheath 28 which provides suitable flexibility of the cable 16. A first snap connector or plug 30 is suitably fixedly and electrically joined to the leads 26 at one end of the cable 16. A second snap connector or plug 32 is complementary to the first snap connector 30.

Means are provided for electrically and removably connecting together the first and second snap connectors 30, 32 for establishing electrical connection with the computer 10, and allowing self-disconnection thereof upon yanking of the cable 16 over a range R, as illustrated in FIG. 3, of disconnection angles relative to the computer 10, which range includes at least a hemisphere. The direction perpendicularly outwardly from the back side of the computer 10 represents 0°, with the disconnection range R extending from 0° and up to + and −90° to define the hemisphere. If desired, the disconnection range may be even larger and include a full sphere if desired.

As shown in FIG. 1, the tripping force F may be in any direction which will yank the cable 16 in tension T as illustrated in FIG. 3 for disconnecting the first and second snap connectors 30, 32. The snap connectors will readily disconnect since the electrical cable 16 extending between the computer 10 and the first snap connector 30 is flexible and therefore always allows the tension force T to develop along the engagement axis of the connectors 30, 32 which may therefore be yanked apart. In this way, the snap connectors 30, 32 define a safe-snap or breakaway joint which disconnects the power supply 14 from the computer 10 to prevent or reduce the likelihood that the yanking force will pull the computer from the table 18 to drop to the floor 20.

As shown in FIG. 2, the cable 16 preferably includes a base connector 34 electrically joined at a proximal end of the leads 26 for connecting the cable 16 to the computer 10, with the first snap connector 30 being joined at an opposite, distal end thereof. The computer 10 includes a pre-defined or standard connecting receptacle 36 in the back side thereof, with the cable base connector 34 being complementary with the receptacle 36 for being removably electrically connected thereto. The computer receptacle 36 is conventional in configuration and includes a plurality of projecting male pins 36*a* suitably electrically joined inside the computer 10 to the battery 12 thereof, for example. The terminal pins 36*a* are suitably disposed inside a recess 36*b*.

Correspondingly, the base connector 34 has an outer profile complementary with the recess 36*b* so that it may be inserted therein, and includes a corresponding plurality of tubular terminal holes 34*a* electrically joined to respective ones of the leads 26. The base connector 34 may therefore be readily inserted into the computer receptacle 36 so that the pins 36*a* slidingly engage the terminal holes 34*a* for establishing electrical connections thereat.

In a conventional electrical cable (not shown) the base connector 34 would be similarly connected to the computer receptacle 36, with the opposite end of the cable being fixedly joined to the power supply 14 of FIG. 1 without additional means for providing disconnection therebetween under a large range of yanking angles.

As shown in FIG. 3, when the base connector 34 is joined to the computer receptacle 36 inside the recess 36*b*, lateral or sideways yanking of the cable 16 (in phantom) will be ineffective in disconnecting the base connector 34 from the receptacle 36, with the attendant result that yanking may cause the computer 10 to be yanked off the table 18 and drop to the floor 20. However, by providing the additional snap connectors 30, 32 between the computer 10 and the power supply 14, yanking tension T carried through the cable 16 may be effectively used for self-disconnecting the connectors 30, 32 irrespective of the yanking direction within the substantially large disconnection range R.

In FIG. 3, the cable 16 is illustrated in solid line in the 0° orientation relative to the backside of the computer 10 which is perpendicular thereto, and is shown in phantom line extending laterally at + and −90° within the disconnection range R. At the exemplary 90° orientation of the cable 16, the base connector 34 cannot readily be dislodged from its mating receptacle 36, but the flexibility of the cable 16 itself allows the snap connectors 30, 32 to move with the cable 16 and remain always coaxial with the yanking tension force T which allows the two connectors to be readily disconnected by the pulling force thereof.

In the preferred embodiment illustrated in FIGS. 1 and 3, the cable 16 defines a first portion wherein the base connector 34 and the first snap connector 30 are attached at opposite ends thereof. The electrical cable further includes a second portion 16*b* which includes the second snap connector 32 at a distal end thereof, and a remote connector 38 at an opposite, proximal end thereof for electrically joining the computer and power supply through the cable to the remote receptacle 24 for obtaining power therefrom.

The power supply 14 is preferably located at a suitable intermediate location between the second snap connector 32 and the remote connector 38, with AC voltage being provided to one end of the power supply 14, and DC voltage being provided through the cable to the second snap connector 32. In the preferred embodiment illustrated in FIG. 1, the cable first portion 16 is preferably shorter than the cable second portion 16*b* to locate the first and second snap connectors 30, 32 adjacent the computer 10 to effect the hemispherical disconnection range R illustrated in FIG. 3.

As the snap connectors 30, 32 are located further away from the computer 10, the possibility of tripping on the cable first portion 16 increases which would then experience the same problems associated with a conventional cable. The snap connectors 30, 32 should be located as closely as possible to the computer 10 so that tripping of the cable occurs in the second portion 16*b* between the second snap connector 32 and the remote connector 38 for effecting self-disconnection of the connectors 30, 32.

As shown in FIG. 3, the length of cable first portion 16 between the base connector 34 and the first snap connector 30 may be made as short as possible for allowing the first snap connector 32 to vary its orientation preferably within the hemispherical disconnection range R, if not greater than that range including up to a full hemisphere if desired. In this way, irrespective of the direction of the yanking force F on the cable second portion 16*b*, the first snap connector 30 and the attached second snap connector 32 may be carried with the cable second portion 16*b* during progression of the yanking force so that they may be readily disconnected by the resulting tension force T acting along the cable.

As shown in FIGS. 2 and 3, the second snap connector 32 and the base connector 34 are preferably substantially identical in configuration and may be directly interchangeable in the computer receptacle 36. The first snap connector 30 is correspondingly configured like the computer receptacle 36 so that the cable first portion 16 defines a relatively short safe-snap extension cord. The first snap connector 30 therefore includes a corresponding number of pins 30*a* like the pins 36*a*, mounted in a corresponding recess 30*b* like the recess 36*b*. The second snap connector 32 includes a plurality of tubular terminal holes 32*a* like the terminal holes 34*a* of the base connector 34.

In this way, the cable second portion 16*b* including the second connector 32 and power supply 14 may be conventional in configuration, with the second connector 32 being directly joined to the computer receptacle 36 without the safe breakaway advantage of the present invention. The cable first portion 16 may be provided as a simple extension cord which is interposed between the computer receptacle 36 and the second snap connector 32 to effect the safe breakaway performance of the present invention. As shown in FIG. 1, the power supply 14 is integrally joined in series in the cable second portion 16*b* without removable connections therein for reducing cost.

However, instead of using the small cable extension 16 illustrated in FIGS. 1–3, a relatively long cable extension designated 16*c* may be used instead, and also instead of the DC portion of the cable 16*b* joined to the power supply 14 as illustrated in an alternate embodiment in FIG. 4. In this embodiment, the second snap connector is designated 32B and is formed directly in one side of the power supply 14, and is preferably identical to the computer receptacle 36. Correspondingly, the first snap connector is designated 30B and is identical to the base connector 34 at its opposite end. In this embodiment, yanking of the cable 16*c* will in turn also yank the relatively small power supply 14 for self-disconnecting the first and second snap connectors 30B, 32B. If desired, the power supply 14 may be mounted on suitable rubber feet for increasing sliding resistance thereof to insure self-disconnection of the snap connectors 30B, 32B under the yanking force instead of yanking of the computer 10 itself.

In the two embodiments disclosed above, the various connectors themselves may take any conventional form which plug together or pull apart along their longitudinal axes. In the exemplary embodiments illustrated, the connectors include four electrical terminals or pins although no more than two are required for providing the DC voltage potential. The additional pins are provided in the exemplary embodiment for providing suitable communication between the computer and the power supply 14 in conventional practice.

Figure 5:
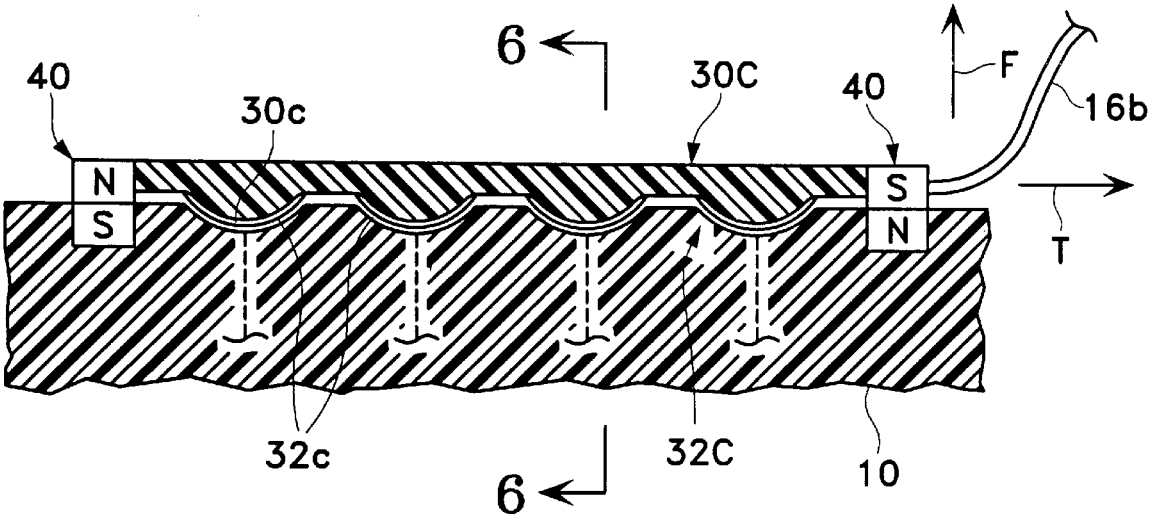
FIG. 5 is a sectional view of a portion of the computer illustrated in FIG. 1 including an electrical cable in accordance with another embodiment of the present invention.
Figure 6:
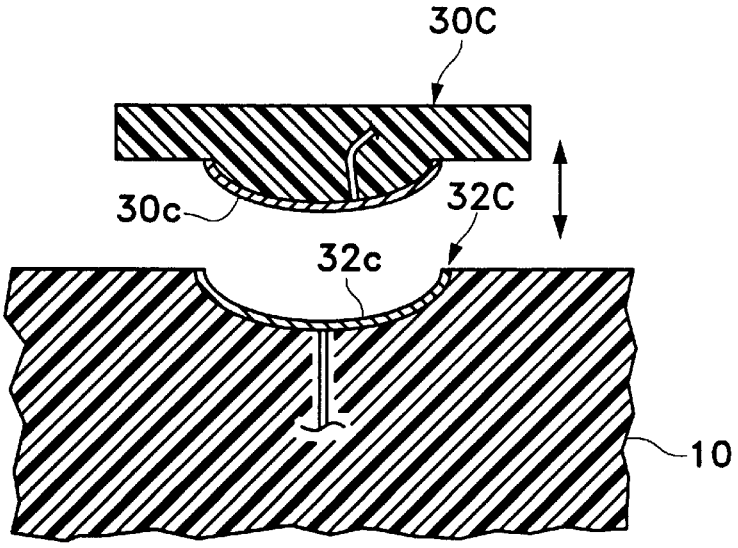
FIG. 6 is a sectional view through the computer and cable connector illustrated in FIG. 5 and taken generally along line 6—6.

FIGS. 5 and 6 illustrate yet another embodiment of the invention where the safe-snap connection is formed directly on the back side of the computer 10 instead of using the conventional computer receptacle 36 illustrated in FIG. 2. In this embodiment, the electrical cable 16*b* is directly attached at one end to the power supply 14, and includes a plurality of convex disks or terminals 30*c* electrically joined to the first snap connector, designated 30C, joined to the opposite, distal end of the cable 16*b*. In the exemplary embodiment illustrated in FIG. 5, there are four terminal disks 30*c* electrically joined to respective ones of the four leads in the cable 16*b*.

A plurality of concave pockets or terminals 32*c* are electrically joined to the battery 12 of the computer 10 to define the second snap connector 32C. The pockets 32*c* are complementary with respective ones of the disks 30*c* for abutting electrical engagement therewith. The pockets 32*c* are preferably shallow in depth, and may be portions of ellipses, for allowing disconnection of the complementary disks 30*c* therefrom upon shear force effected by the yanking tension force T therebetween. The disks 30*c* and the pockets 32*c* are preferably colinearly aligned so that the yanking shear self-disconnects these components horizontally, or the normal force F is effective for pulling apart the connectors vertically.

The first and second connectors 30C, 32C may be suitably biased together by using respective pairs of permanent magnets 40 at opposite ends of the connectors for magnetically mounting the first connector 30C atop the second connector 32C. The developed magnetic force is selected for sufficiently retaining together the connectors during normal operation, but allowing disconnection thereof under a suitable amount of yanking force. Instead of magnets, other retaining device may also be used such as peeling tape known under the trademark of Velcro.

Although the invention has been described above with respect to the power supply 14 temporarily joined to the computer 10, other types of electrical cables may be joined to the computer 10 in a similar manner for effecting safe-snap breakaway performance. For example, the computer 10 may include an internal modem, with a corresponding telephone cable extending from the computer 10 to a remote telephone outlet in the wall. Conventional modular telephone plugs include a locking tab preventing disconnecting of the plug from its receptacle except after being manually depressed. The introduction of the safe-snap connectors in the cable may include otherwise conventional telephone modular plugs without the locking hooks for allowing self-disconnection thereof. As described above, the short cable extension may be used in line with a conventional longer cable extension, with the short, safe-snap cable extension having its remote plug without the locking tab feature for allowing ready disconnection thereof.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the U.S. is the invention as defined and differentiated in the following claims.

I claim:

1. An electrical cable for a portable computer having a receptacle and resting atop a surface above a floor, comprising:

first and second cable portions each having a plurality of electrical leads bound together in a flexible sheath;

a first snap connector joined to said leads at one end of said cable first portion, and a base connector joined to said leads at an opposite end of said cable first portion, and being complementary to said receptacle for being removably connected thereto;

a second snap connector joined to said leads at a first end of said cable second portion and being complementary to said first snap connector, and a remote connector fixedly joined to said leads at an opposite end of said cable second portion for electrically joining said cable to a remote receptacle; and means for allowing self-disconnection of said first and second snap connectors upon yanking of said cable second portion over a range of angles relative to said computer including a hemisphere, and without yanking said computer off said surface to drop to said floor.

2. A cable according to claim 1 wherein said cable first portion is shorter than said cable second portion to locate said first and second snap connectors adjacent said computer to effect said hemispherical disconnection range.

3. A cable according to claim 2 wherein:

said second snap connector and said base connector are substantially identical; and said first snap connector is configured like said computer receptacle so that said cable first portion defines an extension cord.

4. A cable according to claim 2 wherein said cable second portion includes:

a power supply at said distal end thereof for converting line voltage to DC voltage, with said second snap connector being formed directly in one side thereof; and said remote connector is configured to engage a remote receptacle for providing said line voltage to said power supply.

5. A cable according to claim 4 wherein:

said first snap connector and said base connector are substantially identical; and said second snap connector in said power supply is configured like said computer receptacle.

6. A method of self-disconnecting an electrical cable from a portable computer resting atop a surface above a floor, said method comprising: providing a complementary pair of removably interconnected snap connectors between opposite ends of said cable adjacent said computer to form first and second cable portions, with said cable first portion being disposed adjacent said computer and said cable second portion extending therefrom and intended for self-disconnection of said snap connectors upon yanking of said cable second portion without yanking said computer off said surface to drop to said floor.

7. A method according to claim 6 further comprising positioning said snap connector pair more closely adjacent to said cable end at said computer than said opposite cable end.

* * * * *